US005119146A

United States Patent [19]

Nobumori et al.

[11] Patent Number: 5,119,146

[45] Date of Patent: Jun. 2, 1992

[54] PAPER CONVEYING DEVICE HAVING VARIABLE SPEED ROLLERS FOR A PRINTING APPARATUS

[75] Inventors: Shogo Nobumori; Kazuo Sakaki; Yasuo Takano; Tatsuo Matsuda, all of Ibaraki, Japan

[73] Assignee: Hitachi Koki Co., Ltd., Tokyo, Japan

[21] Appl. No.: 609,541

[22] Filed: Nov. 6, 1990

[30] Foreign Application Priority Data

Nov. 17, 1989 [JP] Japan ..... 1-134251[U]

[51] Int. Cl.[5] ..... G03G 21/00; B65H 5/34

[52] U.S. Cl. ..... 355/317; 271/265; 271/270; 271/228

[58] Field of Search ..... 271/265, 270, 225-228; 355/316, 317

[56] References Cited

U.S. PATENT DOCUMENTS

| | | | |
|---|---|---|---|
| 4,260,241 | 4/1981 | Honma et al. | 355/317 |
| 4,318,540 | 3/1982 | Paananen et al. | 271/270 |
| 4,451,027 | 5/1984 | Alper | 271/270 |
| 4,519,700 | 5/1985 | Barker et al. | 271/270 |
| 4,597,660 | 7/1986 | Leng et al. | 355/317 |

FOREIGN PATENT DOCUMENTS

| | | | |
|---|---|---|---|
| 14159 | 1/1983 | Japan | 355/317 |
| 186758 | 10/1983 | Japan | 355/317 |
| 183447 | 9/1985 | Japan | 271/265 |
| 51429 | 3/1986 | Japan | 271/270 |
| 21138 | 1/1987 | Japan | 355/317 |
| 88748 | 4/1987 | Japan | 271/265 |
| 63-30256 | 6/1988 | Japan . | |
| 134459 | 6/1988 | Japan | 271/270 |
| 176232 | 7/1988 | Japan | 271/270 |
| 202540 | 8/1988 | Japan | 271/265 |

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

A paper conveying apparatus which facilitates increased printing speed in a printer, such as a laser printer, by providing rollers which are rotated at different respective speeds at different times during a paper feeding and image transfer operation, so as to provide even feeding of the paper to an image transfer device. The paper is fed, one sheet at a time, relatively rapidly to the image transfer device, and at a slower speed, in synchronism with the image transfer operation, while transfer is being effected.

4 Claims, 2 Drawing Sheets

PAPER CONVEYING DEVICE HAVING VARIABLE SPEED ROLLERS FOR A PRINTING APPARATUS

BACKGROUND OF THE INVENTION

The present invention relates to a paper conveying device in a printing apparatus, such as a laser beam printer, for printing an image on cut paper.

In a conventional cut-paper laser beam printer, as shown in FIG. 1, paper feeding rollers 3 and conveying rollers 5 are rotated first in accordance with a printing command so as to send out an uppermost one of sheets of paper 2 received within a paper feeding cassette 1. When a paper detection device 6 detects the sent-out paper 2, the paper feeding rollers 3 are stopped. The conveying rollers 5 convey the paper 2 to registration rollers 7. Then, the paper 2 abuts the registration rollers 7 so as to be loosened as shown in the drawing so that the direction of meandering is corrected.

Next, when the front end of the paper 2 is made to reach a transfer corotron 9 by the rotation of the registration rollers 7, the registration rollers 7 are rotated in synchronization with the photosensitive drum 8 so that a toner image formed on the photosensitive drum 8 is transferred onto the paper 2 by corona discharge of the transfer corotron 9.

In the above-mentioned conventional paper conveying device of the printing apparatus, paper-feeding speeds of the respective rollers are made equal to each other in order to prevent looseness or extreme tension from occurring on the paper 2. Alternatively, the peripheral speed of the registration rollers 7 is made equal to that of the photosensitive drum 8 during image transfer in order to prevent displacement of the image from occurring while transferring the toner image. That is, the peripheral speed of the respective rollers is selected to be substantially equal to that of the photosensitive drum.

Further, where two sheets of paper are taken in piles from the paper feeding cassette 1, a separation roller 4 is stopped so as to stop the lower sheet of paper so that only the upper sheet of paper is conveyed and succeedingly the lower sheet of paper is sent out. In such a case, the lower sheet of paper is sent out upon detection of a rear end of the upper sheet of the paper by means of the paper detection device 6.

In such a conventional technique, if it is desired to make the speed of continuous printing high, it is necessary to shorten the interval between aligned sheets of paper, and to increase the paper conveying speed. However, to this end, it is necessary to increase the scanning or sweeping speed of a laser beam for exposing the photosensitive drum, and a corresponding increase in speed of all of the processes such as discharge of the photosensitive drum 8, development, cleaning, transferring, and so on. As a result, there have been difficulties in that the apparatus becomes large in size and the manufacturing cost becomes high correspondingly.

Further, in order to attain a high printing speed, the piled-sheet separation mechanism constituted by the separation roller 4, the conveying rollers 5, the paper detection device 6, etc. has been made small in size. However, as the mechanism is made small in size, the piled-sheets separating operation becomes unreliable.

SUMMARY OF THE INVENTION

In view of the foregoing, it is one object of the present invention to provide a paper conveying device in a printing apparatus, in which the printing speed, particularly the continuous-printing speed, is made high economically without making the apparatus large, as described above and without increasing the manufacturing cost.

In order to attain the above and other objects, according to the present invention, the paper conveying device of a printing apparatus includes a paper feeding cassette, paper feeding rollers for drawing out paper from the paper feeding cassette, conveying rollers for conveying the drawn-out paper, registration rollers for further conveying the paper conveyed by the conveying rollers, and a photosensitive drum for forming an image on the paper, wherein peripheral speeds of the paper feeding rollers, the conveying rollers, and the registration rollers are made higher than that of the photosensitive drum.

Preferably, the conveying rollers are made to rotate at a first peripheral speed until a front end of the paper reaches the registration rollers. The conveying rollers and the registration rollers are made to rotate at a second, lower peripheral speed during a period in which the registration rollers are conveying the paper. The photosensitive drum, the conveying rollers, and the registration rollers are made to rotate at a third, yet lower peripheral speed during a period when the image is being formed on the paper by the photosensitive drum. Thus, the first peripheral speed is higher than the second peripheral speed, and the second peripheral speed is higher than the third peripheral speed.

Preferably, the paper conveying device further includes a paper detection device, provided at an outlet portion of the conveying rollers from which the paper is conveyed, so as to measure a paper blank period of time from a time when the paper detection device detects a rear end of one sheet of paper to a time when the paper detection device detects a front end of a succeeding sheet of paper. A difference between the measured period of time and a predetermined period of time is calculated, and rotation of the paper feeding rollers and the conveying rollers is stopped in a period of the calculated difference after the lapse of the measured paper blank period of time.

In the just-described paper conveying device of the printing apparatus according to the present invention, the time taken for paper conveyance from the paper cassette to the transfer corotron is shortened.

DETAILED DESCRIPTION OF THE PREFERRED EMBODIMENT

Figure 1:
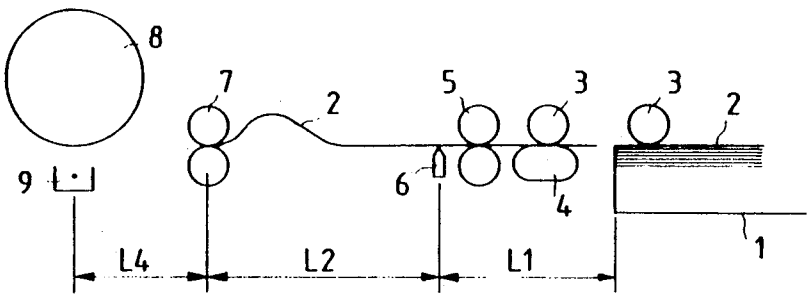
PRIOR ART FIG. 1
FIG. 1 is a diagram for explaining a paper feeding path of an electrophotographic printer.
Figure 2:
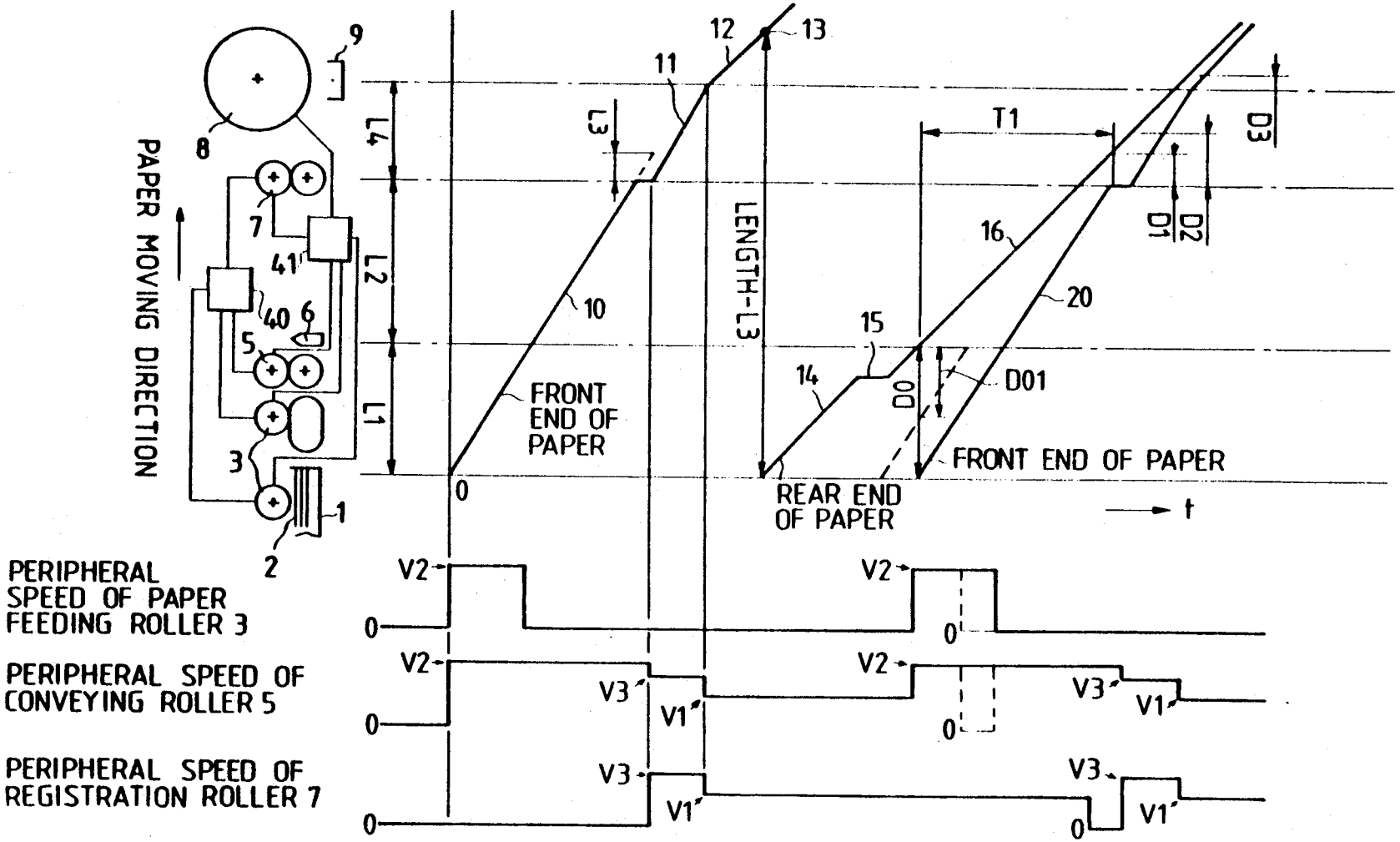
FIG. 2 is a timechart of paper conveyance.

Referring to the drawings, an embodiment of the paper conveying device of the printing apparatus according to the present invention will be described hereunder. FIG. 2 is a timechart showing a paper feeding operation of the embodiment of the present invention. The configuration of the laser beam printer shown in FIG. 1 additionally is shown on the left side of FIG. 2, but additionally has a speed detector 40 coupled to the paper feeding rollers 3, the conveying rollers 5, and the registration rollers 7. Additionally, a controller 41 is coupled to each of rollers, 3, 5, and 7, and the drum 8 to control a speed of each of the rollers and the drum As seen in FIG. 2, paper feeding is started at a point of time t=0, so that paper 2 is sent out from the paper feeding cassette 1 to the registration rollers 7. The conveyance of paper from the paper feeding cassette 1 to the registration rollers 7 corresponds to a portion 10 in the timechart of FIG. 2. In the registration rollers 7, the paper 2 is loosened by an extent corresponding to a length L3 so as to even the front end of the paper 2. Succeedingly, when the registration rollers 7 are made to rotate so as to send forward the paper 2 along a line 11 in FIG. 2 of the drawing, and when the front end of the paper 2 reaches the position of the transfer corotron 9, the paper feeding speed is decreased so as to correspond to the speed of rotation of the photosensitive drum 8, as shown by a line 12 in FIG. 2.

When the front end of the paper 2 reaches a position 13 in FIG. 2, the rear end of the paper 2 separates from the paper feeding rollers, and thereafter the paper 2 is sent forward at the same speed as that of the line 12 until image transfer is completed. The movement of the rear end of the paper 2 corresponds to portions 14, 15, and 16 in FIG. 2. During this period, image transfer is being performed by the transfer corotron 9. The portion 15 shows a state in which the rear end of the paper 3 is stopped by the looseness shown by the portion L3.

Waveforms illustrated on the under side of FIG. 2 show the speeds of rotation of the paper feeding rollers 3, the conveying rollers 5, and the registration rollers 7, so that paper feeding speed is illustrated in correspondence with the above timechart.

The paper feeding rollers 3 and the conveying rollers 5 are made to start rotating at a peripheral speed V2 starting at time t=0. The peripheral speed V2 corresponds to the gradient of the conveying line 10. When the front end of the paper is detected by the paper detection device 6, the paper feeding rollers 3 are stopped, and the paper is advanced only by the conveying rollers 5. When the front end of the paper abuts the registration rollers 7 and the paper is caused to have the looseness L3, the registration rollers 7 are rotated at a peripheral speed of rotation V3. At this time, the peripheral speed of the conveying rollers 5 is decreased to the peripheral speed V3. Succeedingly, when the front end of the paper reaches the position of the transfer corotron 9, the peripheral speed of the two kinds of rollers 5 and 7 is synchronized with a peripheral speed V1 of the photosensitive drum 8.

Thereafter, the registration rollers 7 are made to rotate at the peripheral speed V1 until image transfer is completed. Then, the registration rollers 7 are stopped so as to wait for the following operation. During this period, the next sheet of paper is sent forward so that the just-described operation is repeated.

At this time, if sheets of paper are sent out in piles, the distance $D_O$ between the rear end of a preceding sheet of paper and the front end of the succeeding sheet of paper is shortened to a distance $D_{O1}$, so that the movement of the paper feeding rollers 3 and the conveying rollers 5 is corrected as shown by a dotted line. The correction is performed based on the paper front-end detection by means of the paper detection device 6.

Figure 3:
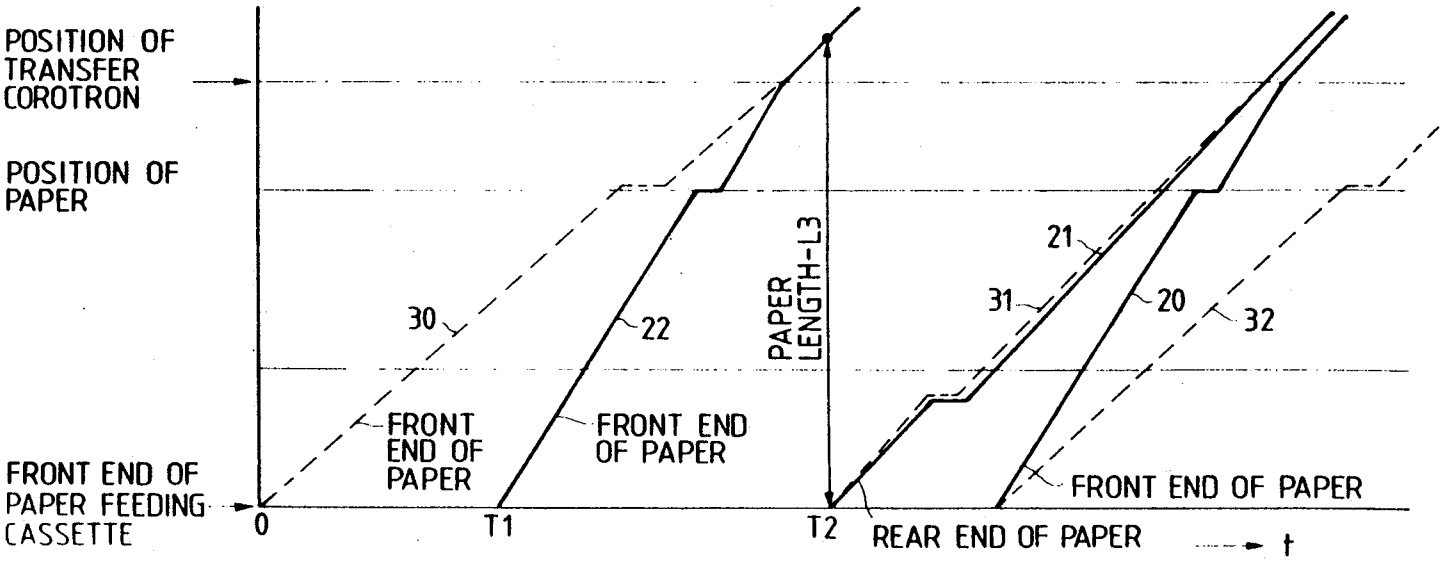
FIG. 3 is a chart for comparing the timechart of the paper conveyance according to the present invention to that of a conventional apparatus.

FIG. 3 is a chart for comparing the timechart of the paper conveyance according to the present invention with that of a conventional apparatus. In FIG. 3, solid lines 20, 21, and 22 show characteristics of the timechart of the present invention shown in FIG. 2, while dotted lines 30, 31, and 32 show characteristics of the timechart of the conventional apparatus. In the conventional apparatus, the paper feeding speed is made equal to the peripheral speed of the photosensitive drum in the range from the paper feeding rollers 3 to the standby roller 7, so that the front end of paper moves as shown by the dotted line 30 in FIG. 3. Accordingly, if the front end of the paper reaches the position of the transfer corotron 9 at a time T2, it is necessary that the conventional apparatus starts feeding paper at time t=0, while it suffices that the apparatus according to the present invention starts feeding paper at time T1, so that the time taken for paper conveyance is shortened by the period of time T1. This is because, according to the invention, the speed of the paper feeding rollers 3, the conveying rollers 5, and the registration rollers 7 is increased. By this increase of the speed, the period of time taken for loosening paper before the registration rollers 7 is shortened by a desired quantity.

After the paper is wound around the photosensitive drum, the rear end of the paper is moved in the same manner as in the conventional apparatus as shown by the lines 31 and 21. Thereafter, the succeeding sheet of paper is inserted in the paper conveying path and similar conveying operation is repeated.

As described above, according to the present invention, the period of time taken for paper conveying from the paper feeding cassette to the photosensitive drum in the electrophotographic printer- is shortened without deteriorating the piled-sheet separating function, so that printing speed can be made high.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. In a printing apparatus, a paper conveying device comprising:

a paper feeding cassette;

paper feeding rollers for drawing out paper from said paper feeding cassette;

conveying rollers for conveying said drawn-out paper;

registration rollers for further conveying said paper conveyed by said conveying rollers, said restriction rollers adapted to adjust tension on said drawn-out paper being conveyed; and a photosensitive drum for forming an image on said paper;

wherein peripheral speeds of said paper feeding rollers, said conveying rollers, and said registration rollers are made higher than a peripheral speed of said photosensitive drum, and said conveying rollers and said registration rollers are rotated at a same peripheral speed during a period in which said paper being conveyed by said conveying rollers abuts said registration rollers, and wherein said registration rollers and said photosensitive drum are rotated at a same peripheral speed during a period in which said image is transferred from said drum to said paper.

2. In a printing apparatus, a paper conveying device comprising:

a paper feeding cassette;

paper feeding rollers for drawing out paper from said paper feeding cassette;

conveying rollers for drawing out paper from said paper feeding cassette;

conveying rollers for conveying said drawn-out paper;

registration rollers for further conveying said paper conveyed by said conveyed rollers;

a photosensitive drum for forming an image on said paper, wherein peripheral speeds of said paper feeding rollers, said conveying rollers, and said registration rollers are made higher than a peripheral speed of said photosensitive drum;

speed detecting means for detecting a speed of each of said paper feeding rollers, said conveying rollers, and said registration rollers;

controlling means for controlling said speed of each o said paper feeding rollers, said conveying rollers, and said registration rollers, and a speed of said drum; and sheet position sensing means for sensing a position of said sheet as said sheet is being conveyed, wherein said conveying rollers are rotated at a first peripheral speed until a front end of said paper reaches said registration rollers;

said conveying rollers and said registration rollers are rotated at a second peripheral speed, lower than said first peripheral speed, during a period in which said registration rollers are conveying said paper; and said photosensitive drum, said conveying rollers, and said registration rollers are made to rotate at a third peripheral speed, lower than said second peripheral speed, during a period when said image is being formed on said paper by said photosensitive drum.

3. A paper conveying device according to claim 2, further comprising paper detection means for detecting paper, provided at an outlet portion of said conveying rollers from which said paper is conveyed and coupled to said controlling means, a paper blank period of time from a time when said paper detection means detects a rear end of one sheet of paper to a time when said paper detection means detects a front end of a succeeding sheet of paper being measured, a difference between the measured period of time and a predetermined period of time stored in said controlling means being calculated by said controlling means, and rotation of said paper feeding rollers and said conveying rollers being stopped by said controlling means in a period of said calculated difference after the lapse of said measured paper blank period of time.

4. In a printing apparatus, a paper conveying device comprising:

a paper feeding cassette;

paper feeding rollers for drawing out paper from said paper feeding cassette;

conveying rollers for conveying said drawn-out paper;

registration rollers for further conveying said paper conveyed by said conveying rollers;

a photosensitive drum for forming an image on said paper, wherein peripheral speeds of said paper feeding rollers, said conveying rollers, and said registration rollers are made higher than a peripheral speed of said photosensitive drum, speed detecting means for detecting a speed of each of said paper feeding rollers, said conveying rollers, and said registration rollers;

controlling means for controlling said speed of each of said paper feeding rollers, said conveying rollers, and said registration rollers, and a speed of said drum;

sheet position sensing means for sensing a position of said sheet as said sheet is being conveyed; and paper detection means for detecting paper, provided at an outlet portion of said conveying rollers from which said paper is conveyed and coupled to said controlling means, a paper blank period of time from a time when said paper detection means detects a rear end of one sheet of paper to a time when said paper detection means detects a front end of a succeeding sheet of paper being measured, a difference between the measured period of time and a predetermined period of time stored in said controlling means being calculated by said controlling means, and rotation of said paper feeding rollers and said conveying rollers being stopped by said controlling means in a period of said calculated difference after the lapse of said measured paper blank period of time.

* * * * *